US006511212B2

(12) United States Patent
Wang

(10) Patent No.: US 6,511,212 B2
(45) Date of Patent: Jan. 28, 2003

(54) LUMINAIRE LATCH

(75) Inventor: James P. Wang, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/850,409

(22) Filed: May 8, 2001

(65) Prior Publication Data

US 2002/0167813 A1 Nov. 14, 2002

(51) Int. Cl.[7] ..... F21V 21/00
(52) U.S. Cl. ..... 362/374; 362/375; 362/455
(58) Field of Search ..... 362/267, 311, 362/374, 375, 453, 454, 455, 457, 223

(56) References Cited

U.S. PATENT DOCUMENTS

| | | | | |
|---|---|---|---|---|
| 1,339,695 A | * | 5/1920 | Douglas | 362/374 |
| 1,414,088 A | * | 4/1922 | Kuen | 362/374 |
| 1,589,760 A | * | 6/1926 | Kuen | 362/374 |
| 3,096,029 A | | 7/1963 | Berge | |
| 3,340,393 A | | 9/1967 | Franck | |
| 3,654,453 A | | 4/1972 | Jablonski | |
| 3,878,388 A | | 4/1975 | Germany | |
| 4,410,931 A | | 10/1983 | DeCandia | |
| 4,516,196 A | | 5/1985 | Blake | |
| 4,654,768 A | | 3/1987 | Dryman | |
| 5,278,745 A | | 1/1994 | Kelly | |
| 5,615,947 A | | 4/1997 | Shambo | |
| 5,865,532 A | | 2/1999 | Bonazzi | |

* cited by examiner

*Primary Examiner*—Y. My Quach-Lee
(74) *Attorney, Agent, or Firm*—Alfred N. Goodman; Mark S. Bicks; Tara L. Hoffman

(57) ABSTRACT

A lighting fixture has a housing with a latching surface, a frame coupled to the housing and having a slot, a refractor or lens supported by the frame, and a latching member coupled to the frame. The latching member includes a main flexing portion, a lead portion extending from one end of the main flexing portion and received in the slot of the frame, and a cam portion extending from an opposite end of the main flexing portion. The latching member moves between a released position with the latching member disengaged from the latching surface of the housing, and a latched position with the latching member engaged with the latching surface of the housing.

21 Claims, 3 Drawing Sheets

FIG. 1
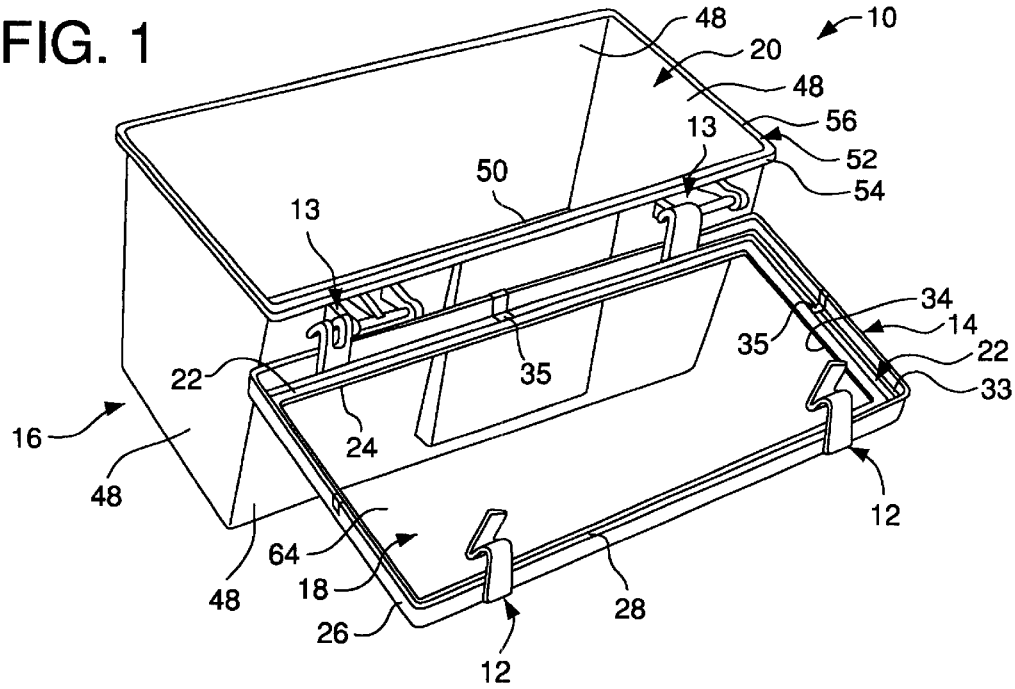
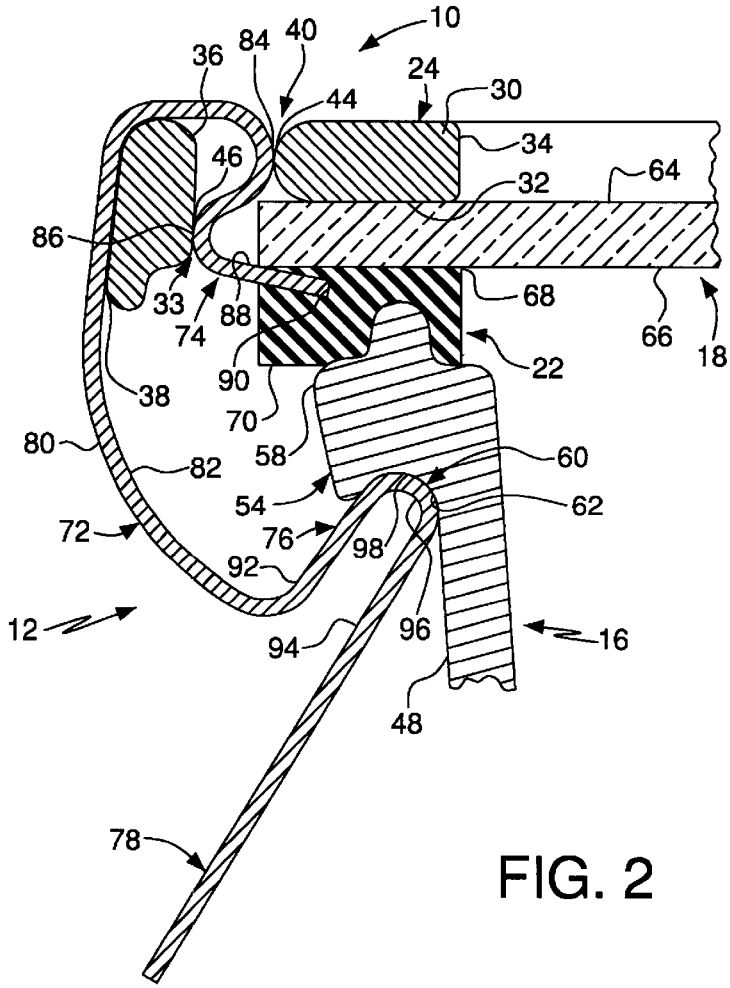
FIG. 2

LUMINAIRE LATCH

FIELD OF THE INVENTION

The present invention generally relates to a door latch for a lighting fixture or luminaire. Specifically, the invention relates to a unitary spring latch that latches a door frame and housing of a lighting fixture without the need for any pins or fasteners. The latch also aids in retaining the lens of the lighting fixture within its door frame.

BACKGROUND OF THE INVENTION

Conventional lighting fixtures or luminaires generally include a housing with a lamp assembly supported therein and a lens attached to and enclosing the housing. Additionally, the lens of a conventional fixture typically includes a frame having a latch that provides a mechanism for opening and closing the lens. The lens and frame define a door for the fixture housing.

Known latches for lighting fixtures typically require the use of multiple parts including separate pins and fasteners to allow the latch to rotate and to secure the latch to the fixture housing. These multiple parts increase manufacturing costs and require assembly of the latch when installing the latch onto a fixture. Also, conventional latches may be difficult to operate, such as requiring the operator to use both hands or more than one tool when opening and closing the latch. In particular, the conventional latches do not provide a mechanism for providing easy access to a fixture housing interior when performing maintenance thereon such as replacing the lamp of the fixture. Moreover, the prior art latches for conventional lighting fixtures do not assist in supporting the lens of the fixture within its frame.

Examples of conventional lighting fixture latches are disclosed in U.S. Pat. Nos. 3,096,029 to Berge; 3,340,393 to Frank et al.; 3,654,453 to Jablonski; 4,410,931 to DeCandia et al.; 4,516,196 to Blake; 4,654,768 to Dryman et al.; 5,278,745 to Kelly et al.; 5,615,947 to Shambo et al.; and 5,865,532 to Bonazzi.

SUMMARY OF THE INVENTION

Accordingly, an object of the present invention is to provide a latch for a luminaire or lighting fixture that provides a mechanism for easily latching and unlatching the lens or door of the fixture, thereby facilitating access to the fixture housing interior.

Another object of the present invention is to provide a door latch for a luminaire that is a unitary one-piece member and does not require the use of separate pins or fasteners.

Yet another object of the present invention is to provide a door latch for a luminaire that facilitates securement of the lens of the fixture in its frame.

The foregoing objects are basically attained by a lighting fixture comprising a housing having a latching surface, a frame coupled to the housing and having a slot, a lens supported by the frame, and a latching member coupled to the frame. The latching member includes a main flexing portion, a lead portion extending from one end of the main flexing portion. The lead portion is received in the slot of the frame and has a lens retaining surface. The latching member also includes a cam portion extending from an opposite end of the main flexing portion. The latching member moves between a released position with the latching member disengaged from the latching surface of the housing, and a latched position with the latching member engaged with the latching surface of the housing.

The foregoing objects are also basically attained by a lighting fixture comprising a housing having a latching surface, a frame coupled to the housing that has a slot, a lens supported by the frame, and a latching member coupled to the frame. The latching member, includes an S-shaped lead portion received in the slot of the frame. The lead portion has first and second frame engaging surfaces and lens retaining surface. The latching member moves between a released position with the latching member being disengaged from the latching surface of the housing, and a latched position with the latching member being engaged with the latching surface of the housing.

By fashioning the latching member of the luminaire in this manner, an operator needs only one hand or tool to move the latching member between latched and released positions. Moreover, separate fasteners are not required to install and retain the latching mechanism.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure:

FIG. 1 is a perspective view of a lighting fixture showing two latches in accordance with the present invention;

FIG. 2 is a side elevational view in section of one latch illustrated in FIG. 1, showing the latch in a latched position and the lighting fixture frame and housing in a closed position;

DETAILED DESCRIPTION OF THE INVENTION

Figure 3:
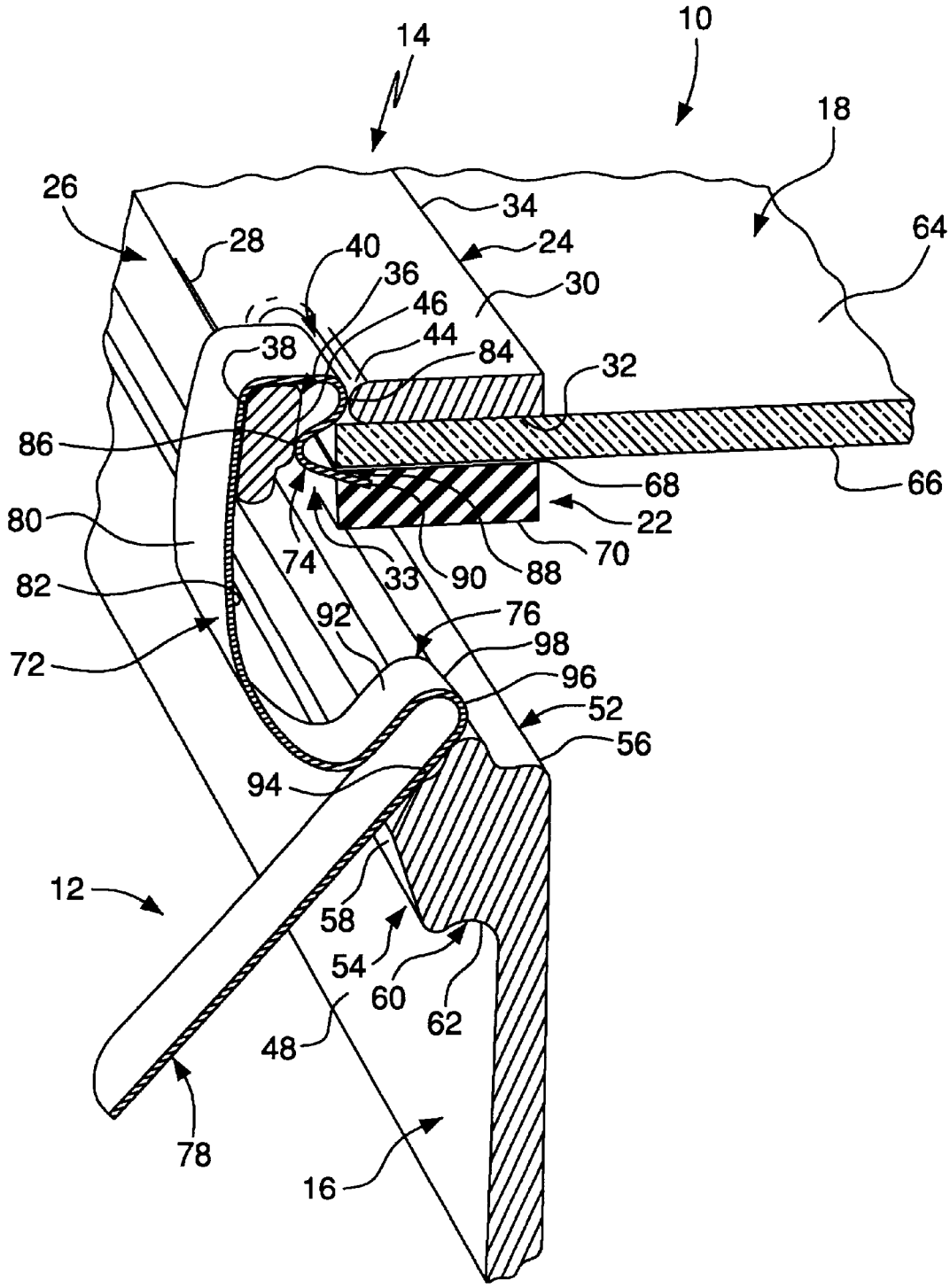
FIG. 3 is a partial perspective view in section of the lighting fixture illustrated in FIG. 1, showing the frame being closed onto the housing.

Referring to FIGS. 1–5, a luminaire or lighting fixture latch 12 in accordance with the present invention latches and unlatches a frame 14 and a housing 16 of a luminaire 10. Latch 12 is preferably a resilient and flexible member, such as a steel spring, that operates without separate pins or fasteners and also assists in supporting a refractor or lens 18 of luminaire 10.

Luminaire 10 generally includes frame 14, such as a door, pivotally coupled to housing 16 by hinges 13 allowing luminaire 10 to be opened and closed, as seen in FIG. 1. The hinges 13 are described in my concurrently filed, co-pending and commonly assigned application Ser. No. 09/850,193 entitled Luminaire Centering Hinge, the subject matter of which is herein incorporated by reference. Luminaire housing 16 includes an inner receiving area 20 for holding lighting components (not shown), such as lamp and socket assemblies, a reflecting member, or a ballast unit, as is well known in the art and shown in U.S. Pat. No. 6,182,848 entitled Luminaire Housing With Universal Dual Surface Cantilever Hinge, the subject matter of which is herein incorporated by reference. Supported by frame 14 is refractor or lens 18, such as a glass panel, with a gasket 22 applied to the perimeter of lens 18 opposite frame 14. Gasket 22 provides a seal when luminaire 10 is closed, thereby protecting the inner components enclosed within inner receiving area 20 of luminaire housing 16. Gasket 22 is preferably made of a plastic or rubber or similar material. center opening 34, as seen in FIGS. 1 and 2. Shoulder wall 26 includes an inner surface 36 defining a receiving area 33 for lens 18 and an outer surface 38 opposite inner surface 36. A slot 40 is disposed in frame wall 24 parallel to its perimeter edge 28 opposite the luminaire hinges 13 and receives a portion of latch or latching member 12. Slot 40 is generally elongated and exposes first and second inner latch abutting surfaces 44 and 46. Slot 40 is preferably less than 1 inch in length but can be any length as long as latch 12 can be accommodated.

Housing 16 is formed of four side walls 48 and an end wall 50 defining inner receiving area 20 with an access opening or open end 52 opposite end wall 50. A shoulder 54 extends along the free edges 56 of side walls 48 at open end 52 for engaging latch 12. In particular, shoulder 54 includes an outer curved or camming surface 58 leading to an undercut or inverted trough portion 60 having a latching surface 62. Latching surface 62 is located between shoulder 54 and side walls 48 of housing 16 as best seen in FIGS. 2 and 3.

Lens 18 is supported in receiving area 33 of frame 14 with a first or upper substantially planar surface 64 abutting lower surface 32 of frame wall 24. A second or lower planar surface 66 abuts an upper surface 68 of gasket 22. A lower surface 70, opposite surface 68, engages housing shoulder 54 when luminaire 10 is closed. Lens 18 extends across central opening 34 allowing light of the lamp assembly enclosed within luminaire housing 16 to shine therethrough. Fasteners 35 can be employed to secure lens 18 within frame receiving area 33, as seen in FIG. 1.

As seen in FIGS. 1–5, latch 12 is a unitary one-piece member preferable made of a flexible and resilient material, such as metal or plastic. In particular, latch 12 is preferably a steel spring. In general, latch 12 includes a main flexing portion 72 with a lead portion 74 extending from one end and a cam portion 76 extending from an opposite end. Also a distal handle portion 78 extends from cam portion 76.

Main flexing portion 72 is curved and has first and second opposing surfaces 80 and 82 forming a generally C-shape. Lead portion 74 is substantially S-shaped and includes first and second frame engaging surfaces 84 and 86 facing in opposite directions, as seen in FIG. 2. Additionally, lead portion 74 includes a lens retaining surface 88 located near the distal end 90 of lead portion 74. Opposite lead portion 74, cam portion 76 includes first and second legs 92 and 94 with a curved intermediate section 96 therebetween forming a generally U-shape with a rounded outer surface 98. Handle portion 78 extends from second leg 94 of cam portion 76 and provides a mechanism for actuating latch 12.

Although latch 12 is preferably a unitary one-piece member, lead portion 74, main flexing portion 72, cam portion 76, and handle portion 78, can be formed separately and integrally attached. Additionally, designation of upper or lower for elements of luminaire 10 and latch 12 are used merely to facilitate description thereof and is therefore not limited to latch or luminaire to any particular orientation. For example, an upper surface can be a lower surface and a lower surface can be an upper surface. Also, more than one latch 12 is preferably used with latch engaging slots 40 of frame 14, respectively. However, any number of latches and corresponding frame slots can be employed with luminaire 10 as desired.

Assembly

Assembly and operation will be described regarding a single latch 12 engaging a corresponding single slot 40 of luminaire 10. However, the same assembly would apply to any number of latches and corresponding frame slots that may be employed.

Referring to FIGS. 1–5, to assemble latch 12 to luminaire 10, lead portion 74 is inserted through frame slot 40. Specifically, the S-shape of lead portion 74 allows distal end 90 of lead portion 74 to extend between lens 18 and gasket 22, slightly displacing gasket 22 to form a recess. Lens retaining surface 88 of lead portion 74 abuts the lower surface 66 of lens 18, thereby sandwiching lens 18 between frame wall 24 and the distal end 90 of lead portion 74. The support provided by lead portion 74 on the lens lower surface 66, provides additional securement of lens 18 in receiving area of frame 14.

The S-shape of lead portion 74 also allows first and second frame engaging surfaces 84 and 86 of lead portion 74 to engage and abut first and second abutting surfaces 44 and 46 of frame slot 40, respectively. As seen in FIGS. 2–5, since first and second frame engaging surfaces 84 and 86 of latch 12 engage the opposing surfaces 44 and 46 of frame slot 40, latch 12 is substantially prevented from moving with respect to frame 14, so that latch 12 can neither rotate nor be removed easily or fall out of frame slot 40. Also, no fasteners or pins are required to couple latch 12 with luminaire 10.

Once lead portion 74 is inserted into frame slot 40, main flexing portion 72 of latch 12 wraps around outer surface 38 of frame shoulder wall 26 so that at least a portion of second surface 82 of flexing portion 72 abuts outer shoulder wall surface 38.

Operation

Once latch 12 is assembled with luminaire 10, luminaire frame 14 and luminaire housing 16 can be latched and unlatched simply and easily using latch 12. As seen in FIG. 3 luminaire 10 is in an open position with latch 12 in a released position and frame 14 spaced from housing 16. Frame 14 moves between open and closed positions with respect to housing 16 by pivoting about hinges 13. Securing frame 14 to housing 16 when in the luminaire is in its closed position and moving latch 12 to its latched position requires the application of force onto frame 14 towards housing 16.

Figure 4:
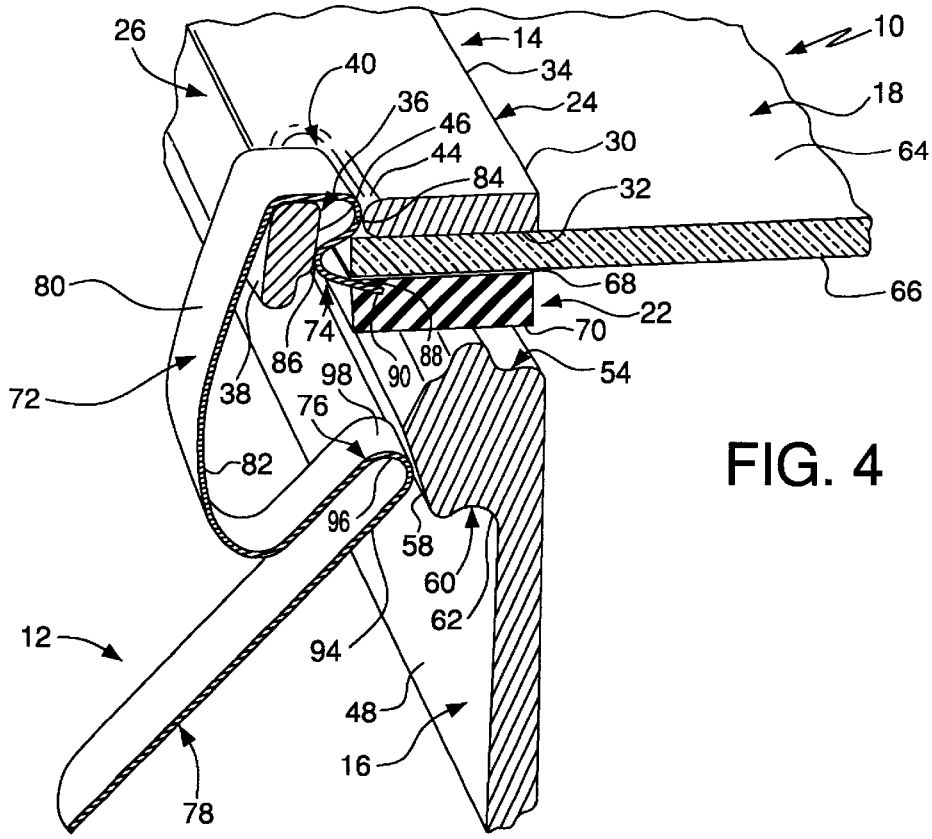
FIG. 4 is a partial perspective view in section of the lighting fixture illustrated in FIG. 3, showing the frame closed onto the housing and the latch in its released position prior to being latched.

As seen in FIG. 4, latch 12 remains in a released position, with frame 14 being closer to housing 16 so that there is either a slight space therebetween or frame 14 and housing 16 are just abutting one another. Cam portion 76 will cam past housing shoulder 54 upon the application of force due to the resilient and flexible nature of latch 12. Specifically, second leg 94 of cam portion 76 initially abuts outer camming surface 58 of housing shoulder 54. The subsequent force applied to latch 12 will move cam portion 76, along housing shoulder 54 bringing intermediate curved section 96 of cam portion into engagement with shoulder camming surface 58.

Figure 5:
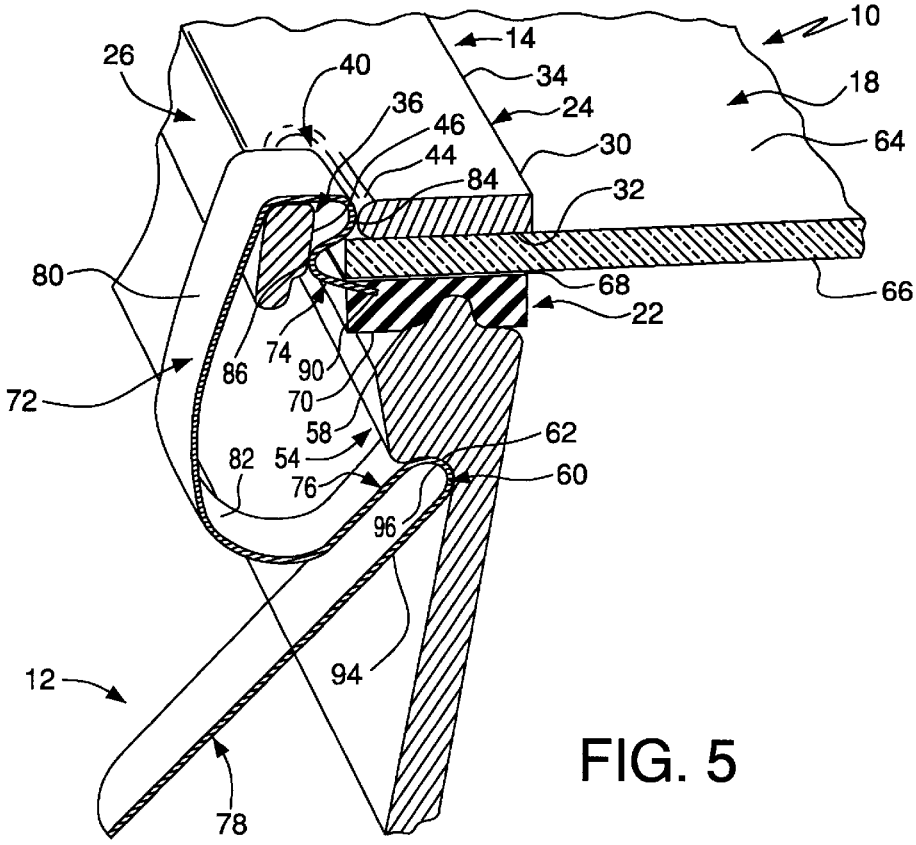
FIG. 5 is a partial perspective view in section of the lighting fixture illustrated in FIG. 4, showing the frame closed onto the housing and the latch in its latched position.

Finally, as seen in FIG. 5, cam portion 76 moves past shoulder camming surface 58 until cam portion 76 is received in undercut section 60 abutting and engaging latching surface 62. This results in cam portion 76 being caught or hooked under housing shoulder 54 thereby securing frame 14 to housing 16 with gasket 22 creating a seal therebetween.

Returning latch 12 to its released position only requires moving handle portion 78 towards latch lead portion 74 and luminaire frame 14, thereby reversing the steps described above for latching latch 12. Since latch 12 is resilient and flexible, upon moving handle portion 78, latch flexing portion 72 will flex away from housing shoulder 54. By moving handle portion 78 toward frame 14, latch 12 will move back to its released position with cam portion 76 being released from undercut section 60 of housing shoulder 54. Frame 14 with latch 12 coupled therewith can then rotated away spaced from housing 16 as seen in FIG. 1.

While a particular embodiment has been chosen to illustrate the invention, it will be understood by those skilled in the art that various changes and modifications can be made therein without departing from the scope of the invention as defined in the appended claims.

What is claimed is:

1. A lighting fixture, comprising:

a housing having a latching surface;

a frame coupled to said housing and having a slot;

a lens supported by said frame; and a latching member including a main flexing portion, a lead portion extending from one end of said main flexing portion and received in said slot of said frame, said lead portion having a lens retaining surface, and a cam portion extending from an opposite end of said main flexing portion, whereby said latching member moves between a released position with said latching member being disengaged from said latching surface of said housing, and a latched position with said latching member being engaged with said latching surface of said housing.

2. A lighting fixture according to claim 1, wherein said lens is located between said frame and said lead portion of said latching member.

3. A lighting fixture according to claim 2, wherein said lens includes first and second opposing surfaces;

said frame abuts said first surface; and said lens retaining surface of said lead portion of said latching member abuts said second surface.

4. A lighting fixture according to claim 1, wherein said lead portion of said latching member includes a frame engaging surface, said frame engaging surface of said latching member abuts with said frame, thereby substantially preventing said latching member from rotating with respect to said frame.

5. A lighting fixture according to claim 4, wherein said lead portion is S-shaped.

6. A lighting fixture according to claim 1, wherein said housing includes a shoulder;

said shoulder includes an undercut portion;

said latching surface is disposed on said undercut portion; and when said latching member is in said latched position, said cam portion of said latching member abuts said latching surface of said housing.

7. A lighting fixture according to claim 6, wherein said housing includes a camming surface, said camming surface is located on an outer portion of said shoulder; and when said latching member is in said released position, said cam portion of said latching member abuts said camming surface of said housing.

8. A lighting fixture according to claim 1, wherein said latching member includes a handle portion extending from said cam portion, whereby actuation of said handle portion moves said latching member between said latched and released positions by flexing said main flexing portion.

9. A lighting fixture according to claim 1, wherein said housing includes a camming surface; and said cam portion of said latching member abuts and cams past said camming surface of said housing when moving said latching member from said released position to said latched position.

10. A lighting fixture according to claim 1, wherein said frame and said lens are separate members; and said latching member is a one-piece unitary member.

11. A lighting fixture according to claim 8, wherein said latching member is a spring member.

12. A lighting fixture, comprising a housing having a latching surface;

a frame coupled to said housing and having a slot;

a lens supported by said frame; and a latching member including an S-shaped lead portion received in said slot of said frame, said lead portion having first and second frame engaging surfaces and lens retaining surface, whereby said latching member moves between a released position with said latching member being disengaged from said latching surface of said housing, and a latched position with said latching member being engaged with said latching surface of said housing.

13. A lighting fixture according to claim 12, wherein said first and second frame engaging surfaces of said latching member abut different surfaces of said frame, respectively, thereby substantially preventing said latching member from rotating with respect to said frame.

14. A lighting fixture according to claim 12, wherein said latching member includes a main flexing portion, a cam portion remote from said lead portion, and a handle portion extending from said cam portion.

15. A lighting fixture according to claim 12, wherein said lens is located between said frame and said lead portion of said latching member; and said lens retaining surface of said lead portion abuts a surface of said lens.

16. A lighting fixture according to claim 12, wherein said latching member is a one-piece unitary member.

17. A lighting fixture, comprising:

a housing having peripheral shoulder with a latching surface and a camming surface;

a frame pivotally coupled to said housing remote from said latching surface, said frame having a slot;

a lens supported by said frame; and a spring member including a main flexing portion, an S-shaped lead portion extending from one end of said main flexing portion and received in said slot of said frame, said lead portion having a lens retaining surface, and a cam portion extending from an opposite end of said main flexing portion, whereby said spring member moves between a released position with said spring member being disengaged from said latching surface of said housing, and a latched position with said cam portion of said spring member engaging and sliding past said camming surface of said housing and into engagement with said latching surface of said housing.

18. A lighting fixture according to claim 17, wherein said lens and said frame are separate members;

said lens is located between said frame and said lead portion of said spring member; and said lens retaining surface of said lead portion abuts a surface of said lens.

19. A lighting fixture according to claim 17, wherein said lead portion includes first and second frame engaging surfaces abutting different surfaces of said frame, respectively, thereby substantially preventing said spring member from rotating with respect to said frame.

20. A lighting fixture according to claim 17, wherein said spring member includes a handle portion extending from said cam portion, whereby actuation of said handle portion moves said spring member between said released and latched positions by flexing said main flexing portion of said spring member.

21. A lighting fixture according to claim 17, wherein said housing comprises a resilient seal between said peripheral shoulder and said lens; and said lead portion extends into said seal.

* * * * *